US009624691B2

(12) United States Patent
Uljens

(10) Patent No.: US 9,624,691 B2
(45) Date of Patent: Apr. 18, 2017

(54) KEY AND DISC TUMBLER CYLINDER LOCK

(71) Applicant: ABLOY OY, Joensuu (FI)

(72) Inventor: Peder Uljens, Turku (FI)

(73) Assignee: Abloy Oy, Joensuu (FI)

( * ) Notice: Subject to any disclaimer, the term of this patent is extended or adjusted under 35 U.S.C. 154(b) by 328 days.

(21) Appl. No.: 14/371,157

(22) PCT Filed: Feb. 14, 2013

(86) PCT No.: PCT/FI2013/050174
§ 371 (c)(1),
(2) Date: Jul. 8, 2014

(87) PCT Pub. No.: WO2013/121114
PCT Pub. Date: Aug. 22, 2013

(65) Prior Publication Data

US 2014/0373581 A1 Dec. 25, 2014

(30) Foreign Application Priority Data

Feb. 16, 2012 (FI) ..... 20120050
Feb. 16, 2012 (FI) ..... 20120051
Feb. 16, 2012 (FI) ..... 20120053

(51) Int. Cl.
*E05B 19/02* (2006.01)
*E05B 29/10* (2006.01)
(Continued)

(52) U.S. Cl.
CPC ..... *E05B 19/0017* (2013.01); *E05B 27/00* (2013.01); *E05B 29/0013* (2013.01); *E05B 19/0047* (2013.01); *E05B 29/0066* (2013.01); *Y10T 70/7559* (2015.04); *Y10T 70/7791* (2015.04)

(58) Field of Classification Search
CPC ..... E05B 19/0017; E05B 29/0013; E05B 19/0047; E05B 29/0046; E05B 19/0023; E05B 19/0035; E05B 19/007; E05B 29/00; E05B 29/002; Y10T 70/7791; Y10T 70/7559; Y10T 70/7633; Y10T 70/7881
USPC ..... 70/376, 377, 365, 366, 403–407, 409, 70/495
See application file for complete search history.

(56) References Cited

U.S. PATENT DOCUMENTS 1,589,256 A * 6/1926 Spruth ..... E05B 29/0013 70/366
2,613,528 A * 10/1952 Salmivuori ..... E05B 21/066 70/366
(Continued)

FOREIGN PATENT DOCUMENTS

CN 201314150 Y 9/2009
CN 101845917 A 9/2010
(Continued)

*Primary Examiner* — Lloyd Gall
(74) *Attorney, Agent, or Firm* — Muncy, Geissler, Olds & Lowe, P.C.

(57) ABSTRACT

A key and a lock cylinder, which are formed such that the guiding the key into the keyhole and the key canal occurs precisely and in a user-friendly manner. The precise placement of the key in relation to the lock cylinder and its parts enables even distribution of the forces directed onto the key and the lock cylinder.

18 Claims, 8 Drawing Sheets

Figure 1:
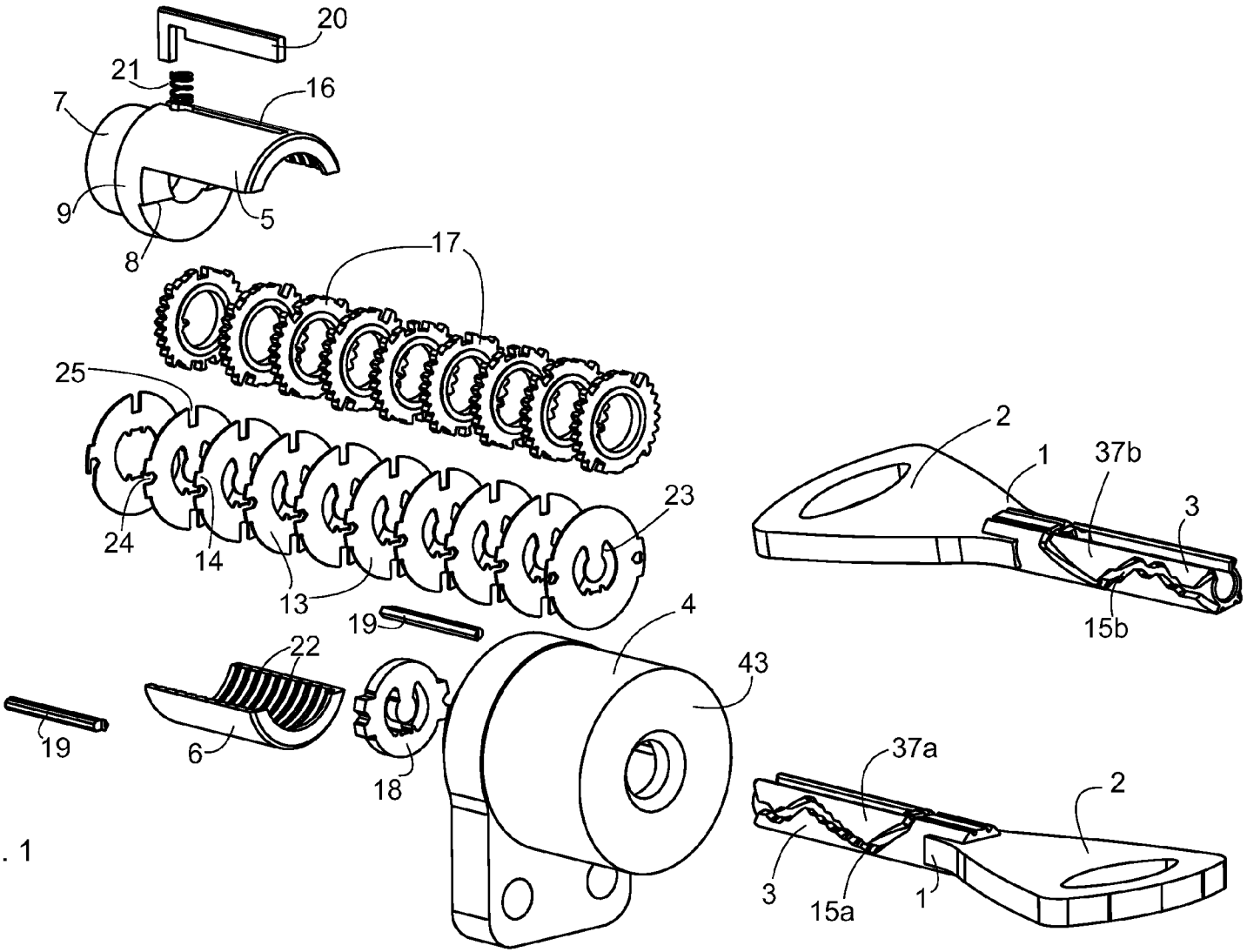

(51) Int. Cl.

| | |
|---|---|
| ***E05B 19/00*** | (2006.01) |
| ***E05B 29/00*** | (2006.01) |
| ***E05B 27/00*** | (2006.01) |

(56) References Cited

U.S. PATENT DOCUMENTS

| | | | | |
|---|---|---|---|---|
| 4,351,172 | A * | 9/1982 | Martikainen | E05B 21/066 70/366 |
| 5,205,143 | A | 4/1993 | Hakkarainen et al. | |
| 5,613,389 | A * | 3/1997 | Hauser | E05B 29/0013 70/366 |
| 6,758,074 | B1 | 7/2004 | Prunbauer | |
| 6,799,447 | B2 * | 10/2004 | Mielonen | E05B 21/066 70/366 |
| 2012/0067091 | A1 | 3/2012 | Agbay | |

FOREIGN PATENT DOCUMENTS

| | | | |
|---|---|---|---|
| CN | 201588450 | U | 9/2010 |
| DE | 395252 | | 5/1924 |
| EP | 0 488 619 | A1 | 6/1992 |
| EP | 1279788 | A1 | 1/2003 |
| EP | 2233667 | A1 | 9/2010 |
| EP | EP 2 453 084 | A2 | 5/2012 |
| FI | 905909 | | 5/1992 |
| FI | 121191 | | 8/2010 |
| GB | 157882 | A | 6/1921 |
| GB | 646486 | | 11/1950 |
| GB | 1 503 586 | A | 3/1978 |
| JP | 2002283471 | A | 10/2002 |
| NZ | 502734 | A | 10/2001 |
| WO | WO 89/11014 | | 11/1989 |
| WO | WO 92/08862 | A1 | 5/1992 |
| WO | WO 2008/034345 | A1 | 3/2008 |

* cited by examiner

KEY AND DISC TUMBLER CYLINDER LOCK

FIELD OF THE INVENTION

This invention relates to a key and a disc tumbler cylinder lock, as well as a combination of these. In particular, the invention relates to a key and a disc tumbler cylinder lock, in which inserting the key into the key canal of the cylinder lock turns the disc tumblers from locked positions into a given position, in which the cylinder lock is unlocked.

PRIOR ART

In disc tumbler cylinder locks, discs are used to form the state locking the cylinder lock. This state can be opened using the correct key, which turns the disc tumblers into such a position, in which the cylinder lock is unlocked. This unlocked state means that the inner cylinder of the cylinder lock can be turned by the key. At the same time, an element incorporated into the inner cylinder, such as a lever or shaft, turns, which further guides, for example, a bolt. The cylinder lock can be incorporated, for example, into lock bodies intended for doors or the body of a padlock. Cylinder locks are used to a very great extent in guiding the lock bolt of door locks.

It is known that inserting a key into the key canal does not yet turn the disc tumblers into the unlocked position, rather the key must still be turned approximately 90 degrees. The invention does not relate to these types of disc tumbler cylinder locks or to their keys but to disc tumbler cylinder locks and keys, in which inserting the key into the key canal turns the tumbler disc into the unlocked position. Cylinder locks, which are used by keys provided with milled guide grooves, are known. The key is inserted axially (in the direction of the key shaft and the key canal) into the lock, and this movement affects via the guide grooves of the key the tumbler discs of the lock such that they turn into a position, i.e. into the unlocked position, which releases the lock mechanism of the cylinder lock and allows turning of the inner cylinder of the lock, i.e. the drum in relation to the surrounding cylinder body. The cylinder body is normally fixedly incorporated into the mechanism, the door lock or corresponding, which is to be opened or closed by the cylinder lock.

Patent publications SE329104 and U.S. Pat. No. 6,758,074 describe these types of disc tumbler cylinder locks and their keys. In both of these publications, a groove or grooves are seen on the surface of the key shaft, which via the pegs of the tumbler discs guide the tumbler discs into the unlocked position, when the key is inserted into the cylinder lock, and correspondingly into the locked position, when the key is extracted from the cylinder lock.

The problems of known solutions have been reliability and ease of use. Wearing of the key and cylinder lock occurs unevenly on different surfaces. Uneven wearing, in turn, causes particularly in old keys and cylinder locks functional disturbances. Production can also be difficult, which increases production costs. Inaccuracies in the guide grooves (particularly in cases of side-by-side or intersecting guide grooves) can cause malfunctioning.

BRIEF DESCRIPTION

The purpose of the invention is to provide an alternative solution to a key and a disc tumbler cylinder lock, which reduces above said problems. The purpose of the invention is achieved in the manner presented in the independent claims. The dependent claims present different embodiments of the invention.

A key according to the invention has two guide grooves for turning the tumbler discs. The part of the key that is to be inserted into the lock (the shaft part of the key) has a primarily cylindrical basic shape, which has a cylinder sector for each of the two guide grooves, which are primarily diametrically arranged in relation to each other to their own side of the key. This design makes the key strong, and the cylindrical basic shape fully utilizes the space available to the part of the key to be inserted into the lock, i.e. the keyhole and the key canal. At the same time, the surface of the areas available to the guide grooves of the key is maximized. Additionally, it becomes easier to shape the guide grooves optimally by arranging them to a surface, the shape of which corresponds to the shape of the central opening of the tumbler discs. Additionally, the cylindrical basic shape supports and guides the tumbler discs, and transfer of force to these from the key occurs efficiently by the maximum possible key radius. The shaft of the key comprises a longitudinal, central cylindrical cavity and torque-transferring, longitudinal guide surfaces on both sides of the cylinder sectors intended for the guide grooves. The shaft of the key also comprises a lateral cut, which extends to the central cavity and preferably is narrower than this, and also comprises edge surfaces shaped as torque-transferring guide surfaces, which along with the key are intended for a collaborative guiding of the cylinder lock.

The cylinder lock comprises an exterior lock housing and inside it a turnable inner cylinder, which encloses a set of turnable tumbler discs. The tumbler discs are arranged to lock and correspondingly to release a lock rod moving radially in the lock, which, in the locking position, is arranged to prevent turning of the inner cylinder in relation to the lock housing and, in the releasing position, is arranged to release turning of the inner cylinder in relation to the lock housing. The tumbler discs have a central opening, which is dimensioned to allow the axial inserting and extracting of the key. Via the radial projections, i.e. the pegs in the central opening of the tumbler discs, the guide grooves of the key affect the tumbler discs by a turning force to place the tumbler discs into a position releasing or correspondingly locking the lock rod, as the key is inserted into the lock and as the key is extracted from the lock. The lock has also elements, which are arranged to bind and centralize the tumbler discs in relation to the inner cylinder, immediately when the inner cylinder is turned in relation to the lock housing by the torque transferred from the key.

By a key blank is meant a key, the cross-sectional shape (key profile) of which is predetermined, but which lacks machining corresponding to a given lock combination. In this description is used, for simplicity, primarily only the term key. It should be noted that this term means, mutatis mutandis, also key blanks.

LIST OF FIGURES

Figure 2:
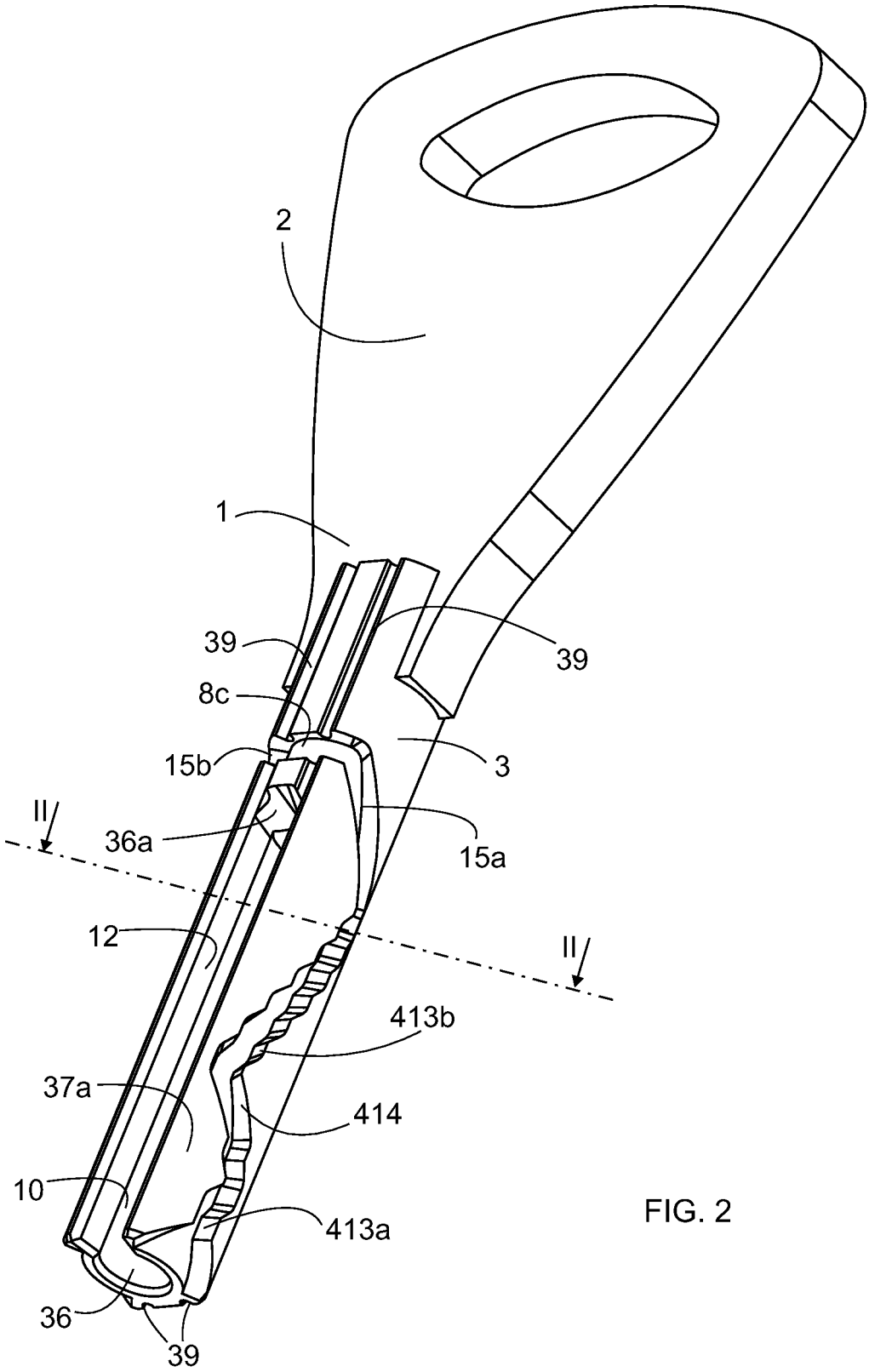
Figure 3:
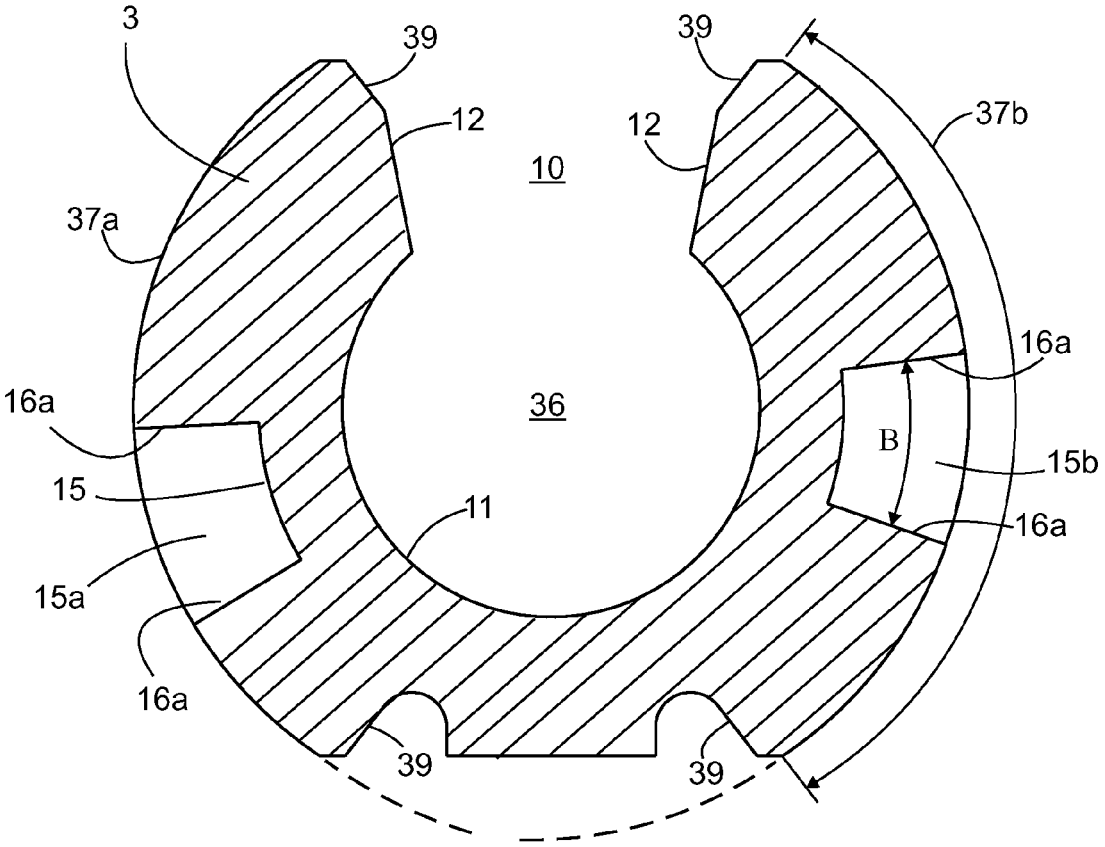
Figure 4:
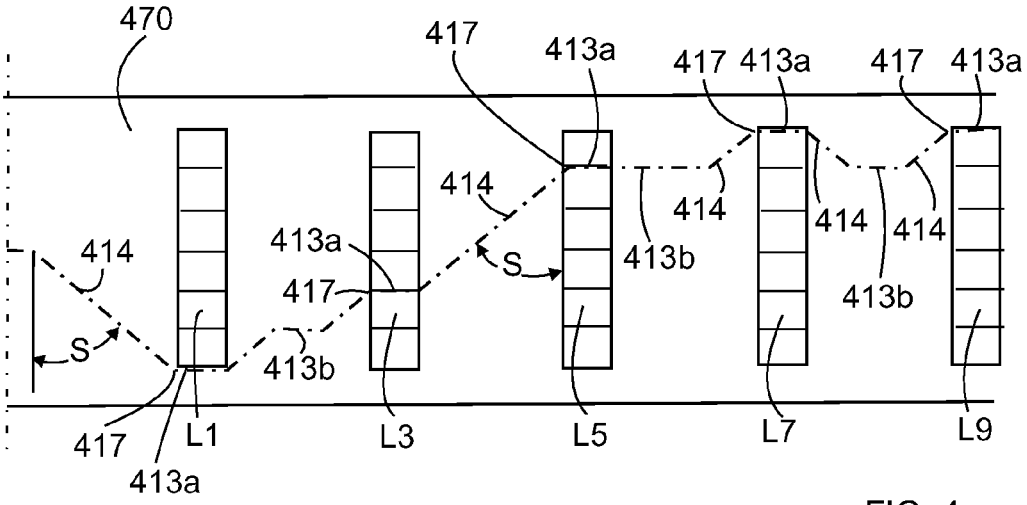
Figure 5:
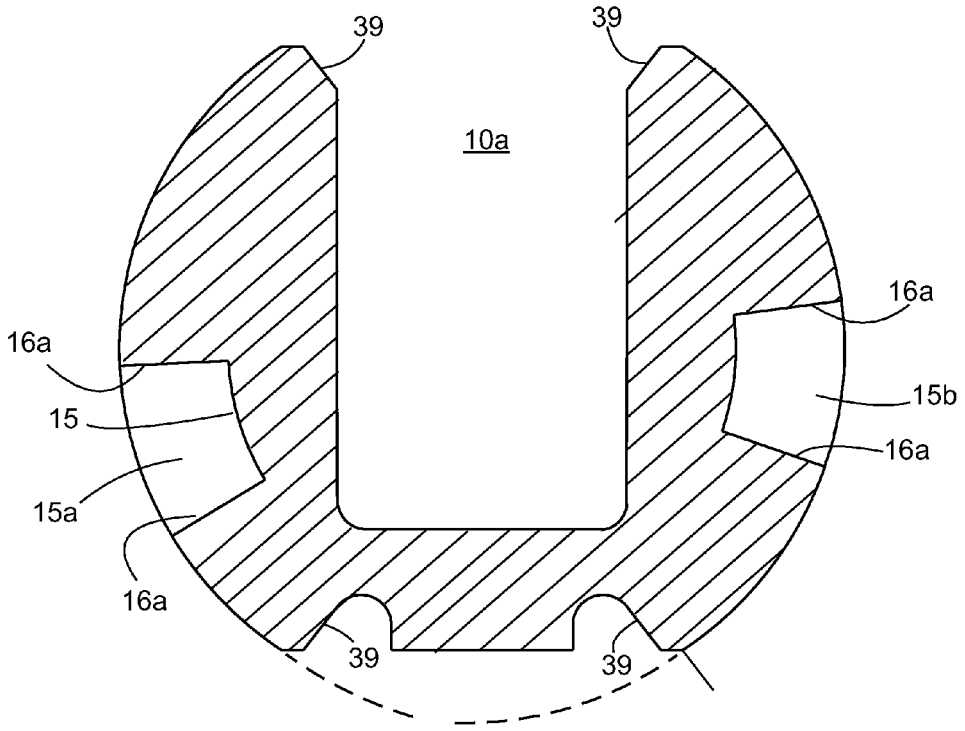
Figure 6:
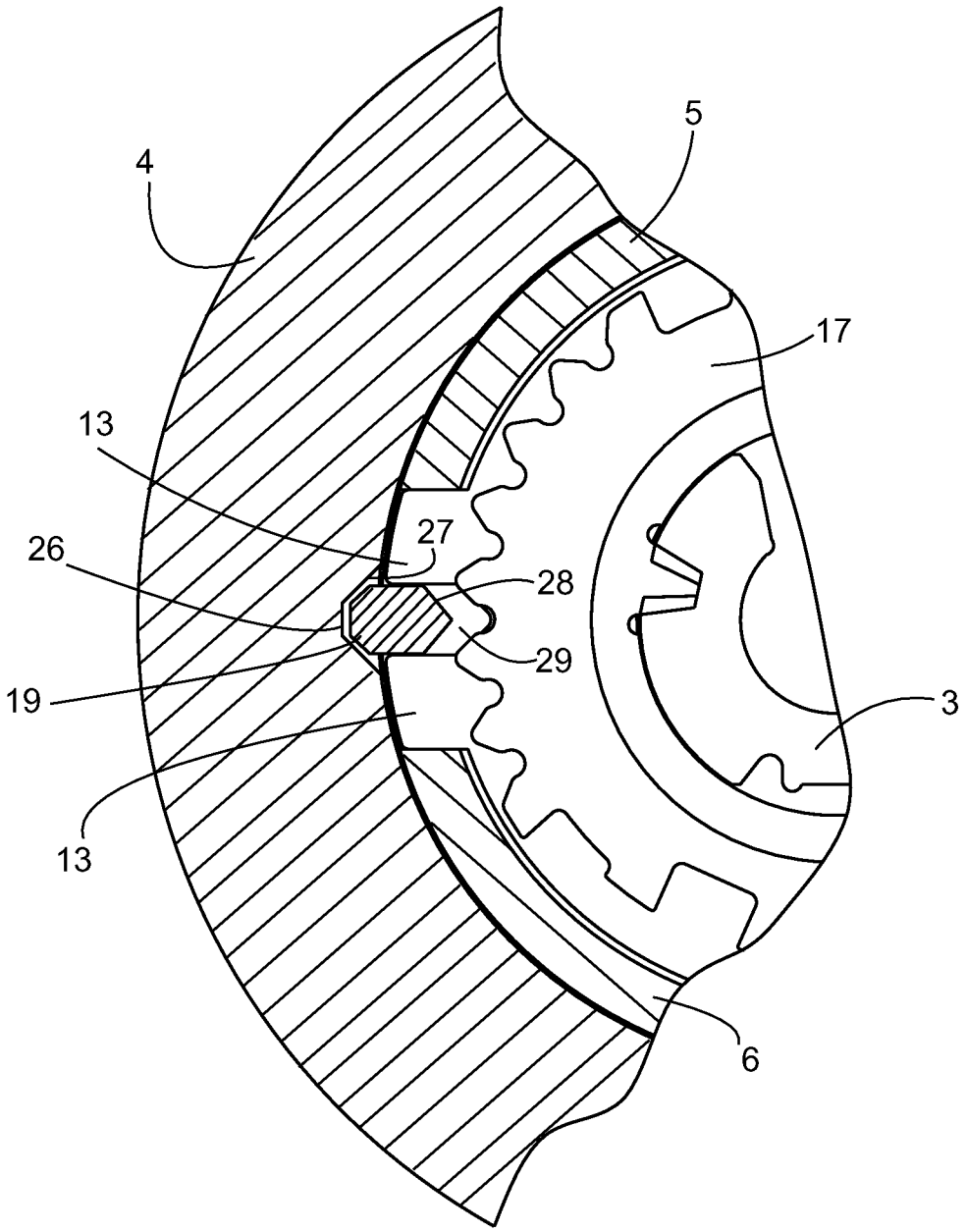
Figure 7:
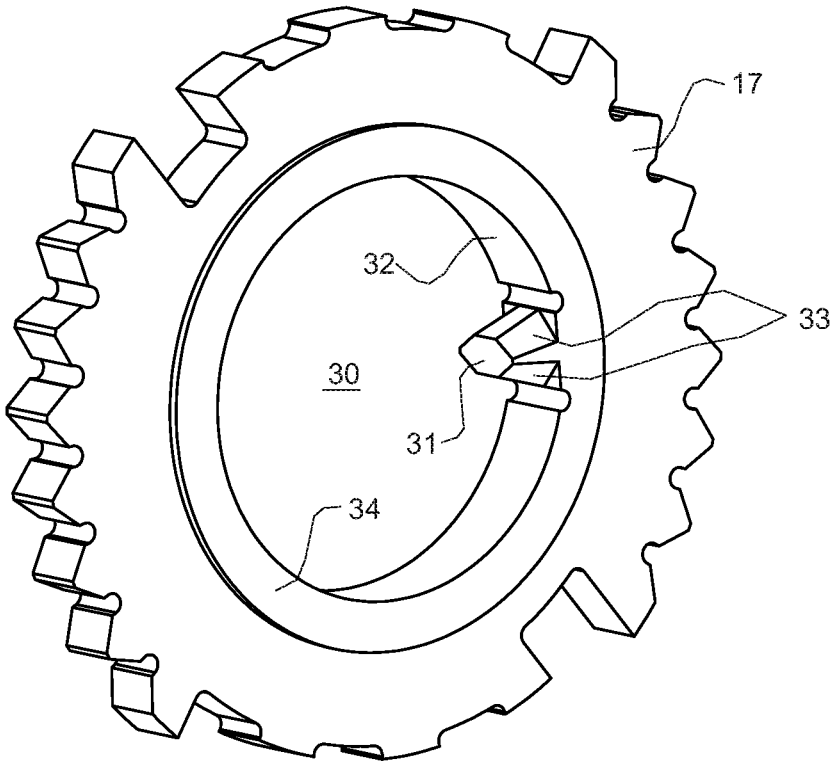
Figure 8:
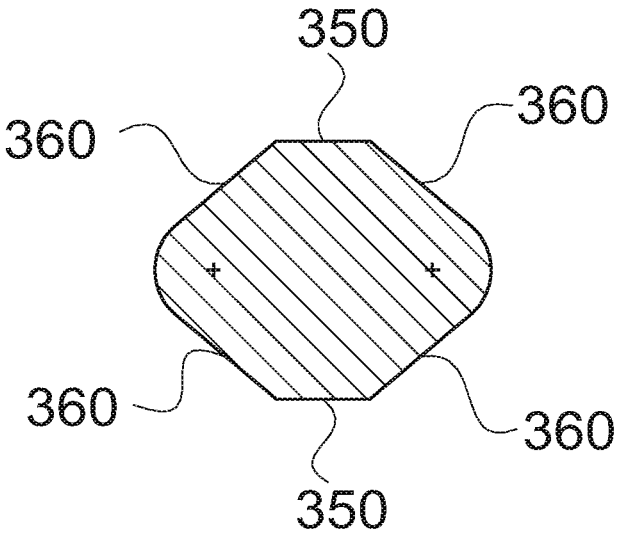
Figure 9:
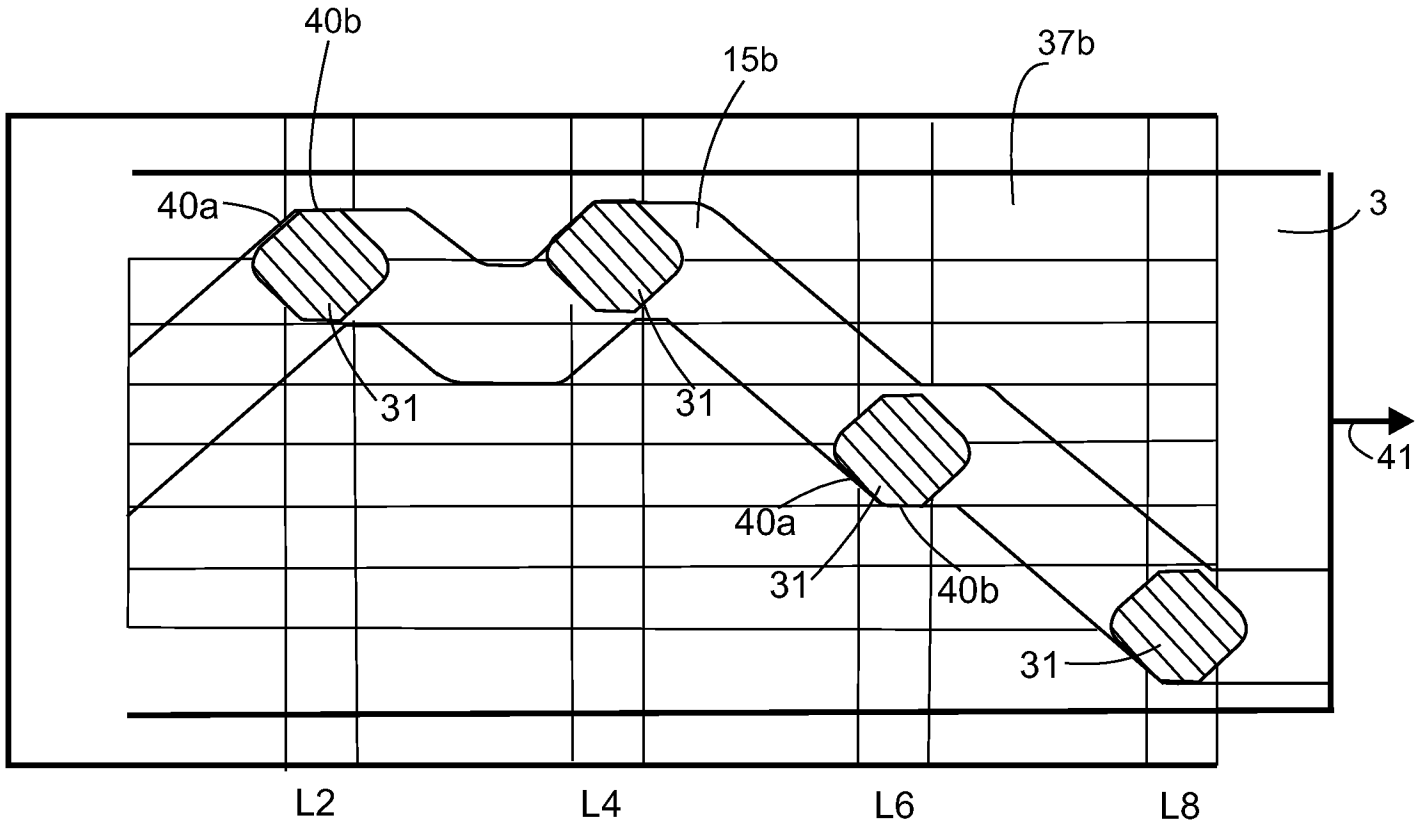
Figure 10A:
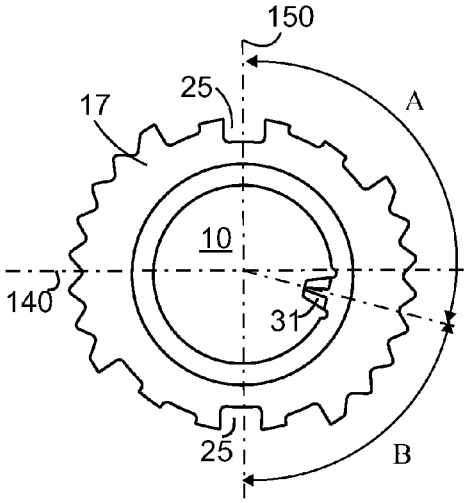
Figure 10B:
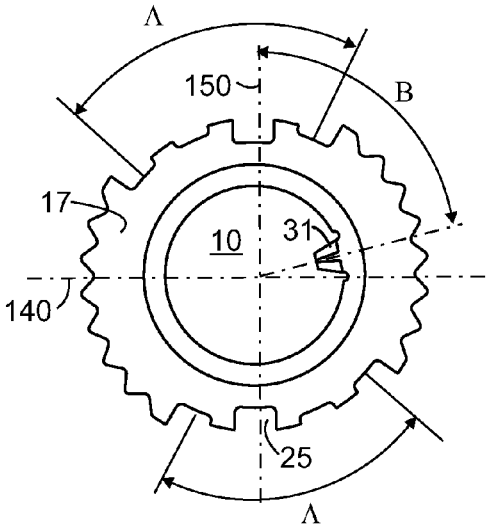
Figure 10C:
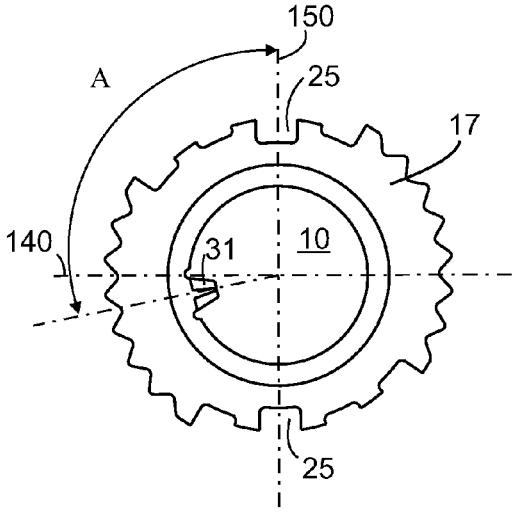
Figure 10D:
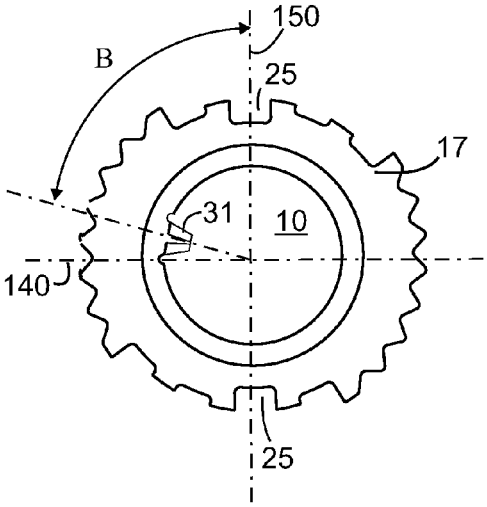

In the following, the invention is described in more detail by referring to the accompanying schematic drawings, in which FIG. 1 is an exploded perspective view example of a lock according to the invention, FIG. 2 is a perspective view example of a key according to the invention, FIG. 3 is a cross-sectional view of FIG. 2 along the line II-II, FIG. 4 is a diagrammatic view example of the guide grooves assembly, FIG. 5 shows another example of the cross-sectional shape of the key, FIG. 6 is a cross-sectional view of a part of a lock according to FIG. 1, FIG. 7 is a axonometric view of a tumbler disc for a lock according to the invention, FIG. 8 is a cross-sectional view of a tumbler disc pin, FIG. 9 is a diagrammatic view of a tumbler disc pin settling against the guide grooves of a key, FIGS. 10A-10D show different installation possibilities for a tumbler disc according to the invention.

DESCRIPTION

FIG. 1 shows parts of a cylinder lock according to the invention. Other parts, such as the locking ring, are known. The key 1 of the lock is shown in two positions. The key has a key leaf 2 and a shaft 3 to be inserted into the lock, which shaft has a primarily circular cross-sectional shape (key profile) and which has a guide groove 15 on each side. The key 1 is intended for using a cylinder lock, which cylinder body 4 having a cylindrical inner surface encloses a turnable drum, i.e. inner cylinder, having a part 5 shaped like a cylinder section, which comprises also a cylindrical head 9 of the drum incorporated into the output shaft 7 of the lock. The cylinder section-shaped casing part 6 of the drum, i.e. the inner cylinder, forms a complementary part to the body part 5 of the drum. As the lock is assembled, either the casing part 6 or the corresponding body part 5 section can form an easily accessible base for setting into place the spacer plates 13 and the tumbler discs 17 of the lock. Both parts 5 and 6 of the drum have inner grooves 22, into which are placed the spacer plates 13. The grooves 22 attach the spacer plates 13 axially and through these also the tumbler discs 17. The edges of the parts 5 and 6 may also be provided with the grooves.

In the next stage of assembling the lock, the casing part 6 is set against the gradation 8 in the body part, which means that the body part 5 and the casing part 6 form together an even less complete cylinder surface. In this manner, two axial gaps are created between the body part 5 and the casing part 6, the cylinder section-shaped surfaces of which form an extension to the cylindrical head 9 of the body part dimensioned to correspond to the cylindrical inner surface of the cylinder body 4. The parts 5, 6 and 9 of the drum are kept in place inside the cylinder body by some suitable means, such as a Seeger-ring or corresponding. The cylinder body 4 is attached normally directly to the lock housing of the door lock, whose function it is desired to guide by means of the cylinder lock.

A cylinder lock according to FIG. 1 has ten spacer plates 13 and between these nine tumbler discs 17. The lock further comprises a lock rod 20, which can move radially in the axial gap 16 in the body part 5 of the drum. The spring 21 loads the lock rod 20 radially outwards towards the locking position, in which the lock rod 20 is partially in the gap 16 and partially in the groove in the cylindrical inner surface of the cylinder body 4. The tumbler discs 17 keep the lock rod 20 in this position, and it prevents, in this case, turning of the drum 5, 6 and the output shaft 7 of the lock in relation to the cylinder body 4. When the key 1 of the lock is inserted into the lock, it turns with its guide grooves 15 the tumbler discs 17 into a position, which allows the lock rod 20 to go into the releasing position. The drum 5, 6 and the output shaft 7 of the lock can then be turned in relation to the cylinder body 4.

The spacer plates 13 are attached in a non-turnable manner in relation to the drum by tabs 14 radially protruding from the spacer plates, which tabs fit into axial gaps formed between the body part 5 and the casing part 6 of the drum. In the middle of the tabs 14 is a recess 24 for the attachment rod 19. The spacer plates 13 have a central opening 23, whose shape defines, which key profile can be used and in which position the key 1 can be inserted into the lock. On the inside of the front wall 43 of the cylinder body 4 is a profile plate 18 incorporated into the drum 5, 6, which profile plate, in the same manner as the spacer plates 13, defines the key profile and the operating position of the key 1. The spacer plates 13 further have a radially directed lock rod recess 25 at a point, which is 90° away from the location site of the recesses 24 intended for the attachment rods 19. When the key 1 is inserted into the lock and when it has with its guide grooves 15 turned the tumbler discs 17 into a position, which allows the lock rod 20 to move radially inwards and thus be released from the cylinder body 4, the drum 5, 6 can turn in the cylinder body 4. Transfer of force from the key 1 into the output shaft 7 of the lock occurs at this time from the key 1 onto the spacer plates 13 and from these onto the drum 5, 6 and into the shaft 7 and from these onto the door lock, which is required to be mechanically incorporated into the shaft 7.

Although above is presented an inner cylinder, which is formed from two main parts, i.e. is then divided as two parts, it is also possible to form a one-part inner cylinder, wherein attachment of the spacer plates to the inner cylinder occurs via an indentation or cut in the inner cylinder.

A cylinder lock according to the invention comprises then parts 19, which, when releasing the drum using a key in relation to the cylinder body, are arranged to attach and centralize the tumbler discs in relation to the drum when turning the drum in relation to the cylinder body using the torque transferring from the key (FIG. 6). By this is achieved the advantage that all the tumbler discs become locked into a precisely defined position in relation to the drum, which eliminates all radial play between the tumbler discs and the drum. In short, the position of the pegs of the tumbler discs is precisely defined, wherein it becomes considerably easier to form a key such that the force between the key and the tabs of the spacer plates spreads evenly to all the pegs. By attaching and centralizing the tumbler discs in relation to the drum according to that described is achieved yet another added advantage. In this case, the lock namely withstands lockpicking attempts exceptionally well. When the tumbler discs are well attached, it is practically impossible to attempt using different tools to make soundings to find that position of the tumbler discs, which releases the lock mechanism.

The attaching and centralizing of the tumbler discs in the drum can be reliably achieved by arranging between the cylinder body and the tumbler discs two attachment rods 19, which are located on a circumference approximately 90° away from the lock rod of the lock. Via the groove in the inner surface of the cylinder body, the attachment rods are arranged to guide radially inwards into a locking contact with the tumbler discs already in connection with the initial turning of the drum. For each attachment rod is arranged in the drum a notch or corresponding notch-like guide surface, which can be formed by recesses in a set of fixed plates, for example, spacer plates, arranged axially one after the other, which normally are between the tumbler discs in a cylinder lock.

To intensify the attaching affect of the attachment rods, suitably the side of the rods pointing radially inwards is made radially inwardly narrowing in shape and the tumbler discs are provided with radially inwards extending recesses, which on the contact area correspond to the radially inwards pointing shape of the side of the attachment rods. Because the tumbler discs can, due to their function, go only a limited number of defined turning positions to enable turning of the drum, as for turning positions, it is simple to provide each of these with recesses intended for the attachment rods.

In FIG. 2 is marked with 1 the key, which has a key leaf 2. From the key leaf 2 extends the shaft 3, which is intended for inserting into the cylinder lock and which has a primarily circular cross-sectional shape (key profile). At the free end of the shaft 3 is an axial central drilling 36. The axially, centre-located drilling can be utilized for defining different key profiles. The drilling further provides an exceptionally suitable support surface for attaching the key as the guide grooves of the key are milled. By drilling is meant a hole generally, were this hole to have been achieved by any means whatsoever.

The shaft 3 has two guide grooves 15*a* and 15*b*. Each of these lie in its own cylinder sector 37*a*, 37*b*. The guide grooves 15*a* and 15*b* are between the key leaf 2 and the inner end 36*a* of the drilling 36 connected to each other by a cross groove 8*c*, which does not as such possess significance for the function of the key but which has been brought along in order that the milling of both of the guide grooves 15*a* and 15*b* could be done continuously.

The tumbler discs have a peg intended to catch one of the guide grooves 15*a* and 15*b*. When the shaft 3 of the key 1 is inserted into the cylinder lock, the guide grooves 15*a* and 15*b* guide via these pegs the corresponding tumbler discs such that these turn and go into a position, which overrides the preventive measure of the cylinder lock. The shaft 3 of the key further has axially protruding, torque-transferring guide surfaces 39 on both sides of the cylinder sectors 37*a*, 37*b* reserved for the guide grooves 15*a* and 15*b*.

FIG. 3 is a cross-sectional view of the shaft 3 of the key. The shaft 3 possesses a primarily circular cross-sectional shape (key profile) and diametrically opposed to each other two cylinder sectors 37*a*, 37*b*, each of which has a guide groove 15*a* and correspondingly 15*b*. The cylinder sectors are formed to give radial support to the tumbler discs of the lock. It is practical for each sector to be at least 84°. However, if possible depending on the implementation, it is good for the cylinder sector to be at least 110°. By reserving an adequately large sector for the guide grooves of the key, accuracy can be added in the milling of the guide grooves and the turning motion of the tumbler discs can be controlled with the accuracy desired. Also shown in FIG. 2, the lateral cut 10 extends downwards up to the drilling 36 but is narrower than it, so the drilling 36 has a continuous cylinder sector 11, for which it is practical for it to be at least 200°, preferably at least 260°. The edge surfaces 12 of the lateral cut 10 are formed as torque-transferring guide surfaces and are intended to transfer torque via the spacer plates of the cylinder lock into the lock drum. Other torque-transferring guide surfaces 39 are located inside the two diametrically opposed parts of the key shaft 3 and are primarily radially directed. The guide grooves 15*a* and 15*b* have a cross-sectional shape, which expands outwards from the bottom 15 of the groove, wherein the sides 16*a* of the guide grooves are at an angle β of 20°-45° in relation to each other.

The drilling as well as dimensioning and design of the lateral cut can be used in defining different key profiles. In the manner presented above are created the primarily symmetric distribution of guide forces and the loads created by these forces. It is good for the torque-transferring guide surfaces to be primarily radially directed. Thus are avoided radial loads caused by the activities of the guide surfaces.

The theoretical assembly of the guide grooves is better seen from the diagrammatic view of FIG. 4, in which is shown a part of the second cylinder sector 470 in the plane of the view. The guide groove is marked using a dotted line, and the locations L1, L3, L5, L7 and L9 of the tumbler discs guided by this groove are marked. All the oblique sections 414 of the guide groove follow a spiral curve having the same pitch S. The pitch S is suitably below 50° for a key, the diameter of whose shaft 3 is 6 mm.

Generally speaking, in these axial locations of the guide grooves, in which the guide grooves are required to guide a given tumbler disc (combination location), the guide grooves have an axially extending (in the direction of the key shaft) section 13*a*, which, in its endpoint 417 closer to the drilled end of the key 1 (on the left in FIG. 4), changes directly as an oblique groove section 414. A result of this design is a balanced transfer of force in connection with the tumbler disc peg, which the guide groove comprises in the combination location in question.

In such cases, in which, as moving from one combination location to the next combination location, the guide groove cannot achieve the next combination location by following the spiral curve of constant pitch, which is characteristic for the guide groove assembly, a guide groove according to the invention is formed to comprise the intermediate, axially extending section 413*b*. In this manner, it is unnecessary to deviate from the general design principles of the guide groove, which are based on axial sections 413*a*, 413*b* and spiral sections 414 having a constant pitch S.

In order that the objective of the invention is achieved in a simple manner, it is preferable to form the guide grooves of the key such that they comprise, in addition to axially extending sections, oblique sections, the latter of which all follow a spiral curve having a constant pitch. When a spiral is selected that always has the same pitch, milling of the guide grooves is simplified, because angle adjustment is constant in each oblique milling.

To achieve a good contact on the relatively large contact area between the pegs of the tumbler discs and the guide grooves of the key, it is advantageous that every such axial location of the guide grooves of the key, which corresponds to a tumbler disc in the lock guided by the guide groove (combination location), has an axially extending section, which, in its endpoint closer to the more inner end of the key, changes directly to one of said oblique sections. The concept "more inner end of the key" means that end of the key, which extends furthest inside the cylinder lock.

In many cases, two consecutive combination locations are so close to each other that, between their locations, the guide grooves of the key cannot follow only a spiral having the pitch selected to the system. In such cases, according to the invention, the spiral section can be divided such that an axially extending groove section is arranged between the spiral sections closest to the combination locations. In this manner, the principle can be followed throughout that the oblique groove millings are of only one type, which, in turn, assures that the contact pattern between the guide groove and the pin of the tumbler disc is always the same.

By giving to the guide grooves a cross-sectional shape expanding outwards from the bottom of the groove is achieved the advantage that the groove more easily remains clean. The sides of the guide grooves should preferably be at an angle of 20°-45° against each other. From this follows that the grooves are clean and settle well against the peg of the tumbler discs.

When the part of the key to be inserted into the lock further has axially extending, torque-transferring guide surfaces on both sides of the cylinder sectors intended for the guide grooves, the advantage is achieved that the key is guided into the lock precisely, which, in turn, is advantageous for the even distribution of force transfer in connection with the pegs of the tumbler discs. Primarily, the same advantages are achieved, when the torque-transferring guide surfaces are inside the two diametrically opposed parts of the key and are primarily radially directed.

FIG. 5 shows, how keys according to the invention can be formed to possess another, for example, a key profile deviating from FIG. 3 such that the use of key sets or large key series can be entirely prevented in given cylinder locks. For different series can then be used the same lock combinations without compromising lock security. This modification possibility is especially important in the production of different key blank sets, because a lock manufacturer can easily modify his locks for given key profiles and benefit from the fact that key blank series are available, for which, due to a different profile, the application area is strictly limited. The key profile in FIG. 5 deviates from the key profile shown in FIG. 3 in that the lateral cut and drilling are modified as a deep notch 10*a*. This is only one example. Deviating design can also be used in other respects.

As is observed from FIG. 6, the radially more outward part of the attachment rods 19 is placed into the nest groove 26 in the cylindrical inner surface of the cylinder body. The nest grooves 26 have an oblique side surface 27, which, already in the initial turning of the drum 5, 6, forces the attachment rods 19 to move radially inwards towards the tumbler discs 17. In this case, the wedge-like inside edge 28 of the attachment rods 19 presses together with the tumbler discs 17 in the same manner from the shaped recesses 29, as a result of which the tumbler discs 17 attach centrally in the drum 5, 6. The attachment rods 19 are located opposite each other at a point, which is 90° away from the location site of the locking rod 20 of the lock.

The tumbler disc 17 shown in FIG. 7 has a primarily circular central opening 30, which is dimensioned to be in close contact with cylinder sectors 37*a* and 37*b* of the key 1 of the lock, wherein the tumbler discs 17 are guided radially via the key. Each of the tumbler discs 17 has in the central opening 30 a peg 31 intended to function from one of the guide grooves 15 of the key, which peg extends and narrows from the cylindrical interface 32 of the central opening 30 radially inwards. The peg 31 has bevels 33 in order that the guide grooves 15 of the key would attach to it better. The tumbler disc 17 has closest to the central opening 30 a ring-like expansion 34, which forms a thin belt, using which the tumbler disc 17 can be in contact with against the adjacent spacer plate 13. When contact is limited to this thin belt having a small radius, friction forces, which could considerably affect the tumbler discs 17, are decreased.

Those tumbler discs 17, whose pegs 31 lie on the other side of the central opening 30, are guided by the one guide groove 15 of the key 1, and those tumbler discs 17, which lie on the opposite side of the central opening 30, are guided by the other guide groove 15*a*, 15*b* of the key 1. In this case, the concept guide the tumbler disc means that the tumbler disc 17 is turned by the key 1 into a position, which enables releasing of the locking function of the lock. The tumbler discs 17 are arranged in the lock such that every other disc 17 has a peg 31 on the right and every other on the left. The distance between those points, in which the guide groove 15 of the key is to attach to the tumbler disc peg 31, corresponds then to the distance between every other tumbler disc 17, which makes it possible to use larger turning angles for the tumbler discs 17. This technology facilitates even more milling the guide grooves 15 of the key.

It is important that the pegs of the tumbler discs, which function together with the guide grooves of the key, have a shape, which makes the pegs settle so well into the guide groove that they are not subjected to a cutting load that is entirely too great. Settling should simultaneously support the desired evenly distributed loading of the pegs. The cross-sectional shape of the pegs should suitably have two substantially parallel side lines extending vertically in relation to the plane of the tumbler discs, which side lines at each end change to an oblique bevel, the bevel angle and dimension of which is professionally fitted to settle against the oblique part in the guide groove of the lock's key and for the force transfer occurring therein. Additionally, it is advantageous for the force transfer occurring from the guide grooves of the key to the pegs that these be radially inwardly narrowing to achieve a professional fit into the shape of the guide grooves of the lock's key, which guide grooves are, for practical reasons, ordinarily milled primarily using wedge-shaped milling means.

FIG. 8 shows a cross-sectional view of the tumbler disc pin 31 shown in FIG. 7. The cross-section has two substantially parallel side lines 350 extending vertically in relation to the plane of the tumbler discs, which side lines at each end change to an oblique bevel 360, the bevel angle and dimension of which is fitted for settling against the oblique section in the guide groove of the key and for the axial force transfer occurring therein, which is presented in more detail in FIG. 7. As is observed from FIG. 7, the pegs 31 of the tumbler discs narrow radially inwards and fit thus into the guide groove 15*a*, 15*b* of the key, whose sides are according to that presented in FIG. 3 at an angle of 20°-45° against each other.

FIG. 9 shows a cylinder sector 37*b* of the shaft 3 of the key in the plane of the view. In it are marked the locations L2, L4, L6 and L8 of the tumbler discs guided by the guide groove 15*b* of the cylinder sector 37*b*. The figure shows the state, in which the lock is opened by a key 1 and in which the drum 5, 6 is turned in relation to the cylinder body 4, which movement has transferred to a lock installed into a door, which has then opened. When the key 1 is pulled from the key leaf 2 in the direction of the arrow 41, the door, which in this shown state is open, can be made to turn around on its hinges. This movement may require considerable force, if the door is heavy and/or if it is subject to strong wind or resistance from the door frame. The figure shows the pegs 31 of the tumbler discs as obliquely hatched line surfaces. Each of the pegs 31 has on two sides 40*a* and 40*b* contact with the guide groove 15*b*. The contact on the side 40*a* comprises a relatively large surface and transfers the greatest part of the force 41, which transfers from the key into the lock and further onto the door connected to the lock. The contact pattern is the same on each peg 31, which assures that force transfer from the key to the pegs 31 is evenly distributed to all pegs.

A cylinder lock having a grooved key according to the invention is particularly well suited for door lock use, because the key is generally pulled to turn the door open. The axial force transfer between a key and a lock according to the invention and the turning around of the lock drum are so well balanced and so evenly distributed that by pulling from the key it is possible to turn even heavy doors on their hinges using only the axial traction transferred from the key without the risk that damages would be created in the cylinder lock. Only the contact between the pegs and the guide grooves of the key can transfer traction from the key to the door. If the traction is not distributed evenly from the key to all pegs of the cylinder lock, the loading of individual pegs may become so great that the pegs and/or the groove in the key may be damaged. In locks of this type often occur malfunctions due to inaccuracies in the milling of the guide grooves, wear and entirely too great loading both of the guide grooves as well as of the parts in the tumbler discs functioning together with them. Malfunctions are also caused by force transfer between the tumbler discs and deformations in the key in connection with loading.

A key according to the invention and a lock cylinder provide an even distribution of force both as the key is turned and as the key is pulled to turn the door. The key and lock cylinder are thus exceptionally well suited for installation into lock bodies or installation sites, in which there is no intent to use a separate noble. In such installations, the door is turned open by pulling from the key. In order to enable the even distribution of forces, the key has, in the direction of its shaft, torque transfer surfaces (39). The torque transfer surfaces lie clearly in at least three different directions as viewed from the central axis of the key, when the key is turned to release or achieve the locking. The locations of the torque surfaces can be observed from the lateral cut 10 of FIG. 3 and from the location of the grooves on the opposite side of the key. Between these grooves is a straight cut, which also functions as a torque transfer surface. If this cut did not exist, the edges of said grooves would form sharp corners, which would rub against, for example, the pocket of the user and other keys. In this case, the grooves would further be more prone to collecting dirt. The cut also eases placement of the key into the keyhole of the lock cylinder. The cut on the opposite side of the groove shape and between the cylinder sectors enables also variation of the shapes of the key shaft, i.e. profiling. Profiles can also be done on the inner surface of the groove shape, but, in terms of production, it is technically more challenging.

The key has also a central cavity/drilling, which promotes accurate manoeuvrability of the key inside the lock cylinder. Accurate placement of the key to the centre of the inner cylinder is important in order that an attempt can be made to prevent the circumferential surfaces of the tumbler discs from touching the circumference of the inner cylinder as the key is inserted and removed from the cylinder. The round groove shape 36 in the centre of the key shaft shown in FIG. 3, whose opening 10 is narrower than the diameter of the groove shape, guides the key well against the shapes corresponding to the profile plate 18 in the turning centre of the tumbler discs, which is important for good function in this type of cylinder structure. Because the key has guide grooves on opposing exterior surfaces, which are against the pegs of the tumbler discs, the axial traction directed into the key is distributed between these two guide grooves. Production of the cross-sectional shape of the key shaft and the profile plate 18 and the spacer plates 23 of the cylinder is easier in relation to known solutions due to clear and relatively large shapes. The large and relatively open round groove shape 36 in the centre of the key shaft can be arranged to always be downward as it is inserted into the lock, which promotes that the groove remain clean from dust and dirt. The open surface area of the keyhole can be made as small as possible, which decreases the amount of dirt and dust getting into the keyhole, decreases the possibility of vandalism and complicates lockpicking.

The cylinder lock has spacer plates 13, whose central opening has a corresponding centrally located projection with a side neck to the other structure of the spacer plate. As was presented above, due to the clear structures, these projections guide the key in a user-friendly manner to the keyhole and into the key canal formed by the spacer plates and tumbler discs. Also, the cylindrical exterior surface of the key is advantageous for guiding the key into the keyhole. The spacer plates have also small projections and between these an even line on the opposite side as the neck of the centre projection. Because these shapes are relatively low, they facilitate inserting of the key into the keyhole, but, at the same time, also function as elements guiding the key. The locking rods 19 of the lock cylinder precisely lock the tumbler discs 17 in the middle of the inner cylinder by the corresponding recesses 29 of the tumbler discs.

FIGS. 10A-10D show different installation possibilities of the tumbler disc. When the tumbler disc has hollows 25 on opposite sides for a tumbler bar 20, turning the disc upside down (turning from FIG. 10A into the position of FIG. 10B) a second combination value is achieved. The tumbler disc can also be turned sideways (turning from FIG. 10A into the position of FIG. 10C), wherein the tumbler disc receives guiding from the other guide groove of the key. Also in this position, the disc can be turned around (turning from FIG. 10C into the position of FIG. 10D). At the same time, using the same tumbler disc are created thus many different combination values (a given angle value from several possible angle values, which are used to the location of the guide groove of the key for this tumbler disc).

A key according to the invention is easy to produce with great precision. Reliable guiding of the tumbler discs of the lock is achieved, when for both the key and those lock parts, which the key affects or which come into contact with the key, wearing is minimal. The key and the tumbler discs are loaded primarily symmetrically, when there are two guide grooves in the key. Additionally, each guide groove can be used to affect specifically selected tumbler discs, in the case of two guide grooves preferably every other tumbler disc, which gives greater freedom in defining the lock combination of the lock. The cylindrical basic shape of the key utilizes the space of the keyhole in the best manner possible. Using the cylinder sectors of the key, suitable surfaces are achieved for milling of the guide grooves, which surfaces can simultaneously function as guide surfaces for the radial guiding of the key occurring in the lock and as a radial support for the tumbler discs of the lock as well as the spacer plates located between these tumbler discs.

The invention is not limited to the embodiments presented above, but several modifications and variations are possible within the scope of the following claims.

The invention claimed is:

1. A key, which is intended for use in cylinder locks, comprising:

at least two guide grooves arranged in the key;

a part of the key, which has a basic cylindrical shape, to be inserted into the lock shaped to turn turnable tumbler discs by a longitudinal motion performed in the lock, which occurs by the at least two guide grooves arranged in the key, the part of the key to be inserted into the cylinder lock comprising:

a cylinder sector intended for each guide groove; and a lateral cut including edge surfaces shaped as torque-transferring guide surfaces for cooperatively guiding a cylinder lock;

a longitudinal, central cavity; and torque-transferring longitudinal guide surfaces on both sides of the cylinder sectors wherein the lateral cut extends to the central cavity.

2. The key according to claim 1, wherein the torque-transferring guide surfaces existing in at least two diametrically opposed parts of the key are primarily radially directed.

3. The key according to claim 1, wherein the central cavity comprises a sector, which is at least 200 degrees.

4. The key according to claim 1, wherein the part to be inserted into the lock has two opposing cylinder sectors, which are shaped to guide the tumbler discs of the lock, and wherein both of the cylinder sectors extend at least over 84°, which sectors are arranged in relation to each other primarily diametrically, each on its own side of the key.

5. The key according to claim 1, wherein the guide grooves comprise longitudinal parts and, between these, parts travelling at an angle, which follow a spiral curve, whose pitch is constant.

6. The key according to claim 5, wherein every such longitudinal point, which corresponds to a location site of a tumbler disc guided by the guide groove has a longitudinal part in respective guide groove, which, at that endpoint, which is closer to the cavity end of the key, immediately changes to one of said parts travelling at an angle.

7. The key according to claim 1, wherein to the guide grooves is given a cross-sectional shape, which expands in the direction from the bottom of the groove outwards, wherein the sides of the guide grooves are at a 20°-45° angle in relation to each other.

8. The key according to claim 1, further comprising:

a key shaft; and two grooves, which lie on opposite sides of the key shaft in relation to the lateral cut.

9. The key according to claim 8, wherein the key comprises a cut in relation to the cylindrical basic shape of the key between the two grooves.

10. The key according to claim 1, wherein the central cavity is symmetrical and the lateral cut is narrower than the central cavity.

11. A cylinder lock comprising a lock rod radially movable in the lock;

a set of turnable tumbler discs arranged to lock and correspondingly to release the lock rod, the tumbler discs each comprising:

a central opening dimensioned to allow the axial inserting and extracting of a key corresponding to the lock; and a radical projection in the central opening;

an exterior lock housing;

binding rods; and a turnable inner cylinder disposed in the exterior lock housing, the turnable inner cylinder enclosing the set of turnable tumbler discs, which, in the locking position, is arranged to prevent turning of the inner cylinder in relation to the lock housing and, in the releasing position, is arranged to release turning of the inner cylinder in relation to the lock housing, wherein the key has two guide grooves, which are arranged, using a axial movement of the key via the radial projections in the central opening of the tumbler discs, to affect the tumbler discs by a turning force to place the tumbler discs into a position releasing or correspondingly locking the lock rod, wherein as the key is inserted into the lock in a position, which causes the tumbler discs to turn the inner cylinder into the releasing position, the binding rods are arranged to bind and centralize the tumbler discs in relation to the inner cylinder, immediately when the inner cylinder is turned in relation to the lock housing by the torque transferred from the key.

12. The lock according to claim 11, further comprising spacer plates, center openings of which are shaped to correspond to shape of a profile of the key.

13. The lock according to claim 12, wherein the inner cylinder has two gap-shaped guide surfaces, which circumferentially are approximately 90 degrees from a position of the lock rod.

14. The lock according to claim 11, wherein the side of the binding rods directed radially inwards is in shape radially inwardly narrowing and that the tumbler discs have radially inwards directed indentations, which in shape at least partially correspond to the shape of the radially inwards directed side of the binding rods.

15. The lock according to claim 11, wherein the cross section of the radial projections of the tumbler discs have two substantially parallel side lines directed vertically in relation to the plane of the tumbler discs, which, at both ends, change to a bevel, the bevel angle and extension of which are fitted for contact and axial force transfer on an oblique travelling part of the guide groove of key.

16. The lock according to claim 11, wherein the projections of the tumbler discs are radially inwardly narrowing and fitted to the shape of the guide groove of the key.

17. The lock according to claim 11, wherein one of the tumbler discs comprises two hollows for the lock rod, which lie on opposite sides of the tumbler disc.

18. A cylinder lock and key combination, comprising:

a cylinder lock, the cylinder lock comprising:

an exterior lock housing;

a lock rod radially movable in the cylinder lock;

turnable tumbler discs are arranged to lock and correspondingly to release the lock rod;

a turnable inner cylinder disposed in the exterior lock housing, the turnable inner cylinder enclosing the turnable tumbler discs; and a key intended for use in the cylinder lock, the key comprising:

at least two guide grooves arranged in the key;

a part of the key to be inserted into the lock, having a basic cylindrical shape and comprising a cylinder sector intended for each of the at least two guide grooves, shaped to turn the turnable tumbler discs by a longitudinal motion performed in the lock, which occurs by the at least two guide grooves;

a longitudinal, central cavity; and torque-transferring longitudinal guide surfaces on both sides of the cylinder sectors, wherein the part to be inserted into the cylinder lock further comprises a lateral cut, which extends to the central cavity and also comprises edge surfaces shaped as torque-transferring guide surfaces, which are intended with the key for cooperatively guiding the cylinder lock, wherein in the locking position, the lock rod is arranged to prevent turning of the inner cylinder in relation to the lock housing and, in the releasing position, is the lock rod arranged to release turning of the inner cylinder in relation to the lock housing, wherein each tumbler disc has a central opening dimensioned to allow the axial inserting and extracting of the key, and a radical projection disposed in the central opening, wherein the guide grooves are arranged, using the axial movement of the key via the radial projections in the central opening of the tumbler discs, to affect the tumbler discs by a turning force to place the tumbler discs into a position releasing or correspondingly locking the lock rod, and wherein the lock comprises binding rods, which, as the key is inserted into the lock in a position, which causes the tumbler discs to turn the inner cylinder into the releasing position, is arranged to bind and centralize the tumbler discs in relation to the inner cylinder, immediately when the inner cylinder is turned in relation to the lock housing by the torque transferred from the key.

* * * * *